United States Patent [19]

Nakanishi et al.

[11] Patent Number: 4,928,972

[45] Date of Patent: May 29, 1990

[54] IRON CLUB HEAD FOR GOLF

[75] Inventors: Tatsuo Nakanishi; Toyohiko Tadokoro; Masaki Fujimura, all of Hamamatsu, Japan

[73] Assignee: Yamaha Corporation, Japan

[21] Appl. No.: 355,665

[22] Filed: May 23, 1989

Related U.S. Application Data

[63] Continuation-in-part of Ser. No. 70,906, Jul. 8, 1987, abandoned.

[30] Foreign Application Priority Data

Jul. 9, 1986 [JP] Japan ..... 61-161663
Jul. 9, 1986 [JP] Japan ..... 61-161665

[51] Int. Cl.[5] ..... A63B 53/04

[52] U.S. Cl. ..... 273/78; 273/77 A; 273/171; 273/167 H; 273/173

[58] Field of Search ..... 273/78, 169, 171, 172, 273/173, 174, 167 H, 167 F, 167 J, 77 A

[56] References Cited

U.S. PATENT DOCUMENTS

| | | | |
|---|---|---|---|
| 1,671,956 | 5/1928 | Sime | 273/78 |
| 2,447,967 | 8/1948 | Stone | 273/78 |
| 4,355,808 | 10/1982 | Jernigan et al. | 273/169 |
| 4,508,350 | 4/1985 | Duclos | 273/183 D |
| 4,535,990 | 8/1985 | Yamada | 273/173 |

*Primary Examiner*—George J. Marlo
*Attorney, Agent, or Firm*—Lerner, David, Littenberg, Krumholz & Mentlik

[57] ABSTRACT

A fiber reinforcement, which can be of solid or hollow construction, and a synthetic resin back up are disposed in a recess provided on the side of the club head remote from the shooting surface. A mass can be adjustably imbedded in the synthetic resin backup so as to increase the inertial moment of the club head. A rise member extending upwardly from the sole face of the club head can also be provided so that the center of gravity can be more easily adjusted. The fiber reinforcement is relatively thin for shorter shafted golf clubs having high degrees of loft, and increases progressively to a greater thickness for longer shafted golf clubs having relatively small degrees of loft. A back plate made of a woven cloth can be provided adjacent the fiber reinforcement to aid in reinforcing the shooting surface and to withstand the tension acting across the rear of the club head upon impact. The synthetic backup can be transparent or semi-transparent to expose the esthetics of the woven cloth. Bonding tape can be provided between the fiber reinforcement and the main body and between the fiber reinforcement and the back plate to facilitate the manufacture of the club head and to minimize the shock and vibration effect caused by striking a ball.

12 Claims, 4 Drawing Sheets

IRON CLUB HEAD FOR GOLF

This is a continuation-in-part of application Ser. No. 07/070,906 filed July 8, 1987, now abandoned.

BACKGROUND OF THE INVENTION

The present invention relates to an improved iron club head for golf, and more particularly relates to an improvement in construction of an iron club head for golf which is provided with a fiber reinforcement attached in a rear recess of the shooting face.

Two types of iron club heads for golf are presently used in practice. In the case of a sole-piece type, the head is wholly made of metal such as stainless steel, cast iron or brass. In the case of a composite type, a head made of metal is combined with a fiber reinforcement in particular made of carbon fiber reinforced plastic.

An iron club head of the second type is proposed in Japanese Patent Application Sho. 60-214297. In the case of this earlier proposal, a recess is formed on the rear side of the shooting face of a club head, a fiber reinforcement is attached in the recess and a ring is force inserted into the recess to fix the fiber reinforcement in the recess.

With this conventional construction, however, the process of setting the ring takes time and trouble, thereby seriously lowering the productivity. In addition, use of the ring tends to make adjustment in center of gravity very difficult. As a consequence, increase in inertia moment of the iron club head cannot be achieved easily. In addition, since a flat fiber reinforcement is used, distribution of weight is made quite uniform in the peripheral area around the center of the shooting face, i.e. the sweet spot, of the iron club head. Such uniform weight distribution leads to insufficient weight in the peripheral area and, as a consequence, increase in inertia moment of the iron club head cannot be achieved well.

SUMMARY OF THE INVENTION

The basic objects of the present invention are to raise the productivity, provide reinforcement for the striking surface of the club head, damping means for minimizing shock and vibrations, means for increasing the inertial moment of an iron club head for golf and adjusting the center of gravity of a club head.

In accordance with the first basic aspect of the present invention, a fiber reinforcement is attached to a recess formed on the rear side of the shooting face of an iron club head and a synthetic resin backup is filled in the recess covering the fiber reinforcement.

In accordance with the second basic aspect of the present invention, a fiber reinforcement is attached to a recess formed on the rear side of the shooting face of an iron club head and the thickness of the fiber reinforcement is larger in the peripheral region than in the central region.

In accordance with another aspect of the present invention, a fiber reinforcement member and a back insert of chip-like carbon or aramide fibers are united with the main body of the golf club head by a transparent resin.

DESCRIPTION OF THE PREFERRED EMBODIMENTS

Figure 1:
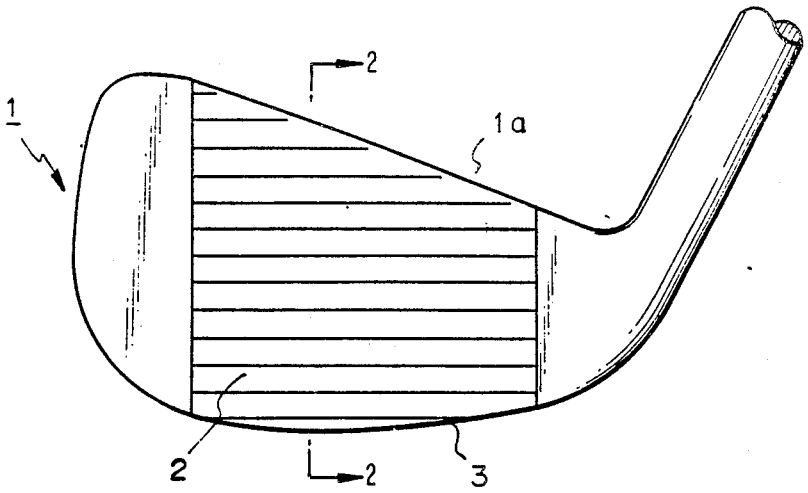
FIG. 1 is a front view of one embodiment of the iron club head in accordance with the present invention.
Figure 2:
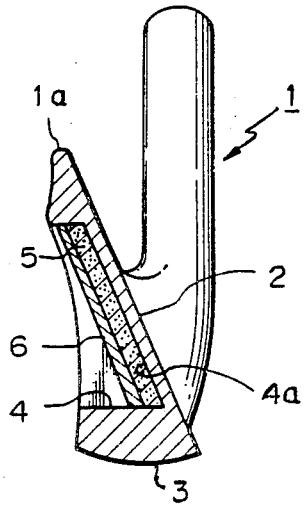
FIG. 2 is a section taken along a line II–II in FIG. 1.

In FIGS. 1 and 2, a head main body 1 is made of, for example, stainless steel, cast iron or brass and has a substantially triangular transverse cross sectional profile so that its shooting face 2 has a prescribed loft angle. More specifically, when seen in the shooting direction, as in FIG. 2, the sole face 3 is thicker than the blade side 1*a*. On the rear side of the shooting face 2, a recess 4 is formed which has a bottom 4*a* substantially parallel to the shooting face 2. A fiber reinforcement 5 is placed in the recess 4 in close contact with the bottom 4*a* of the recess 4. The fiber reinforcement 5 is made of highly elastic material such as carbon fiber reinforced plastic (CFRP). Thus, the section of the head main body 1 supporting the shooting face 2 has a double composite construction. Further, a synthetic resin backup 6 is also placed in the recess 4 covering the fiber reinforcement 5 in order to lock the latter against accidental fall. In production, crude synthetic resin is filled in the recess 4 after setting of the fiber reinforcement 5, which resin is subjected to proper hardening.

The thickness of the section of the head main body 1 providing the shooting face 2 should preferably be in a range from 0.5 to 3.0 mm. and the thickness of the fiber reinforcement 5 should preferably be in a range from 1.0 to 5.0 mm. Thus, the weight of the head main body 1 is reduced by addition of the fiber reinforcement 5 which has a lower volumetric mass than the metals of which the main body 1 is practically comprised.

Figure 3:
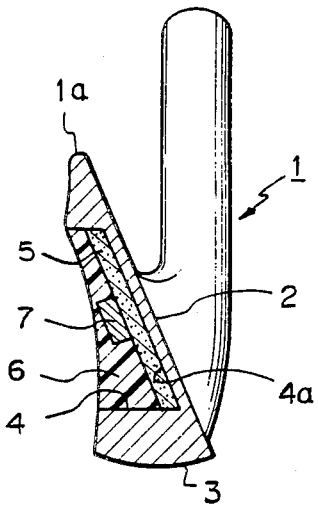
FIG. 3 is a section similar to that shown in FIG. 2 of another embodiment of the iron club head in accordance with the present invention.

In the case of the embodiment shown in FIG. 3, a mass 7 is embedded in the synthetic resin backup 6. The weight of the mass 7 substantially corresponds to the weight of the head main body 1 reduced by the use of the fiber reinforcement 5. By properly adjusting the position of the mass 7, the inertial moment of the iron club head can be increased.

In production of the fiber reinforcement 5, several sheets of reinforcing fibers are combined in layers and the layered combination is impregnated with solution of non-hardened synthetic resin such as unsaturated polyester resin for hardening. Alternatively, several thin, hardened FRP sheets are bonded together in layers.

The fiber reinforcement is given in the form of two-dimensional or three-dimensional woven or knitted cloth. A cloth, a combination of a cloth with rovings, a mat or a mat combined with another cloth or cloth may be used. The fiber reinforcement may preferably contain, in addition to carbon fibers as the major component, aromatic polyamide fibers, glass fibers, boron fibers, silicon carbide fibers and/or alumina fibers.

Figure 4:
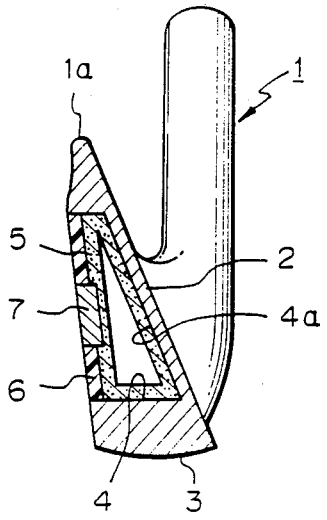
FIG. 4 is a section similar to that shown in FIG. 2 of another embodiment of the iron club head in accordance with the present invention.

In the case of the embodiment shown in FIG. 4, the fiber reinforcement 5 has a cavitatious or hollow construction similar in cross-section to the transverse cross-sectional profile of the head main body 1 so that no significant depression should appear on the rear face of the head main body 1 for aesthetic effect.

Figure 5:
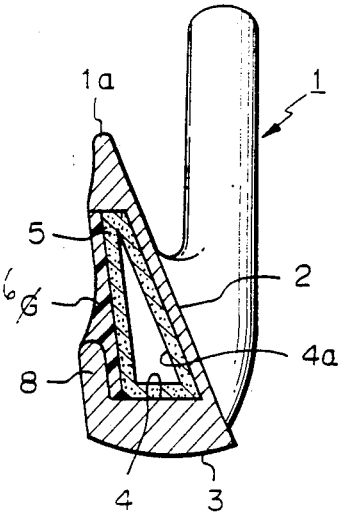
FIG. 5 is a section similar to that shown in FIG. 2 of a further embodiment of the iron club head in accordance with the present invention.

In the case of the embodiment shown in FIG. 5, an upwardly extending rise 8 is formed near the sole face 3 partly covering the synthetic resin backup 6 for better adjustment of the center of gravity. The rise 8 is of a predetermined site, i.e., length, width and/or weight, to accomplish the desired adjustment on the desired club head (for longer shafted/smaller lofted clubs or for shorter shafted/larger lofted clubs).

Figure 6:
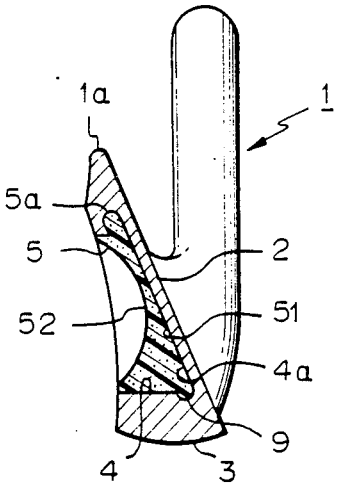
FIG. 6 is a section similar to that shown in FIG. 2 of a further embodiment of the iron club head in accordance with the present invention.

An iron club head in accordance with the second basic aspect of the present invention is shown in FIG. 6. Like the one shown in FIG. 2, the head main body has a rear recess 4 which receives a fiber reinforcement 5. One or more undercuts 9 are formed continuously or locally on the periphery of the bottom 4*a* of the recess 4 in engagement with the periphery 5*a* of the fiber reinforcement 5 in order to lock the latter against accidental separation. The fiber reinforcement 5 has a flat inner face 51 and a concave outer face 52. By properly adjusting the degree of concavity of the outer face 52, the peripheral section of the fiber reinforcement 5 is thicker than the central section and the distribution of weight in the peripheral section of the iron club head can be easily and freely adjusted in order to increase the inertial moment of the iron club head.

Figure 7:
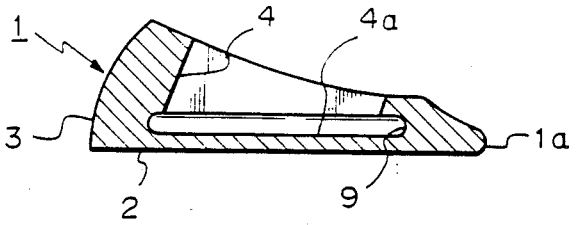
FIGS. 7 to 9 are sectional views for showing one production process of the iron club head shown in FIG. 6.
Figure 8:
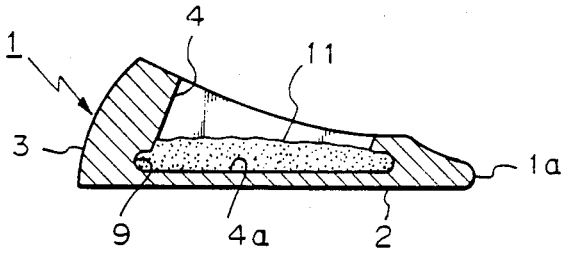
Figure 9:
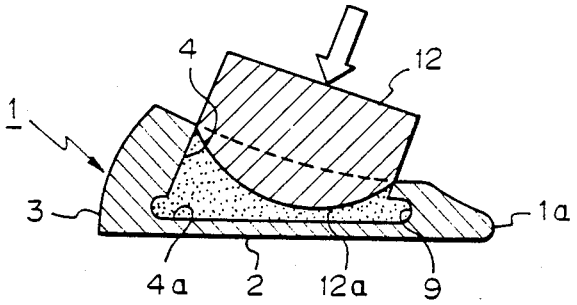

One example of the process for producing such an iron club head is shown in FIGS. 7 to 9. First, a head main body 1 is fixed on a table (not shown) with its shooting face 2 on the underside as shown in FIG. 7. Next, a crude fiber reinforcement 11 is deposited on the bottom 4*a* of the recess 4 and urged to fill the overhang or overhangs 9 as shown in FIG. 8. A presser 12 having a convex head 12*a* is applied to the exposed face of the crude fiber reinforcement 11 as shown in FIG. 9 to form the concave outer surface 52 shown in FIG. 6.

Figure 10:
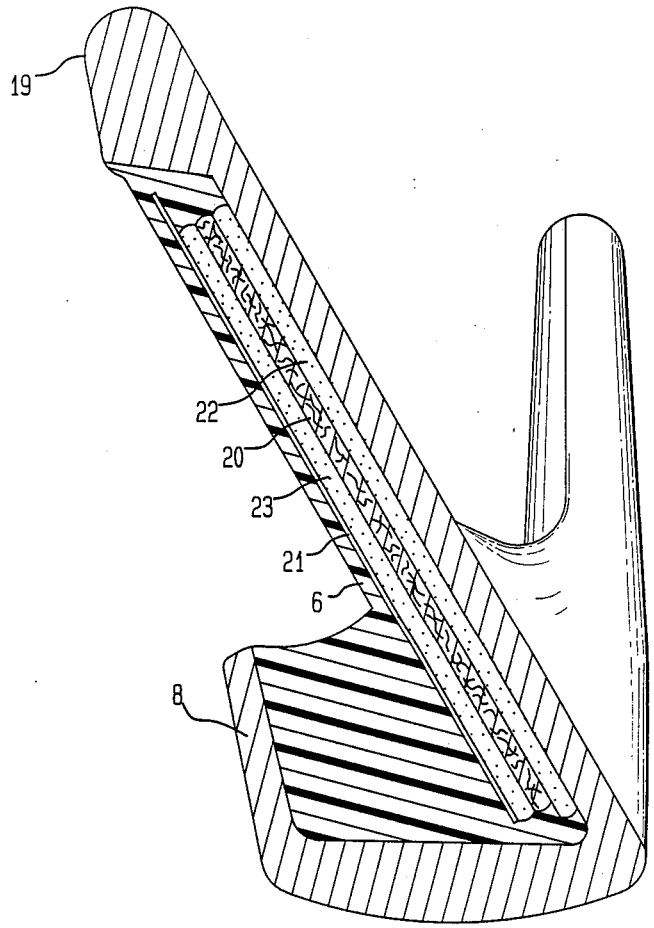
FIG. 10 is a section similar to that shown in FIG. 2 of a further embodiment of the iron club head in accordance with the present invention.

An iron club head in accordance with another aspect of the present invention is shown in FIG. 10. This embodiment is similar to the embodiment shown in FIG. 5 in that it also includes an upwardly extending rise 8 in the configuration of the main body 1. In this embodiment, a back insert 20 and a back plate 21 facilitate the reinforcement of the shooting face 2. The thickness of the back insert 20 can be varied in accordance with the type of club. That is, the back insert 20 is thinner or more narrow for shorter shafted irons having relatively large lofts, and becomes progressively thicker for longer shafted irons having relatively small lofts. Since the relatively small loft on the longer shafted irons causes the application of a larger shock on the striking surface when a golf ball is struck therewith, the back insert 20 is required to have a larger thickness to reinforce the striking surface 2 against such a large shock.

The back insert 20 is made from several layers of chip-like carbon or aramide fibers of about 1 inch in length and several layers of chip-like boron fibers. These layers are bonded together to form the back insert 20. A back insert bonding tape 22 is utilized to maintain the position of the back insert 20 prior to uniting the back insert 20 with the back plate 21 by means of a synthetic resin backup 6. Similarly, a double-bonding tape 23 is used to maintain the position of the back plate 21 with respect to the back insert 20 prior to the introduction and setting of the epoxy resin 6. Both the back insert bonding tape 22 and the double-bonding tape 23 have adhesive on both sides such that there is no space between the back insert 20 and the main body 1 or between the back plate 21 and the back insert 20 for the resin to flow. The back plate 21 is made of a cloth woven from carbon fibers or aramide fibers. This is advantageous as the epoxy resin backup 6 is transparent or semi-transparent such that the back plate 21 and its texture is exposed on the rear side of the club head. Thus, the texture of the woven cloth of the back plate 21 provides aesthetic design and pleasing visual appearance of the club head when viewed from the rear.

The back plate 21, being made of a woven cloth, also facilitates the endurance of the club head as the club head undergoes a bending moment when striking a golf ball. To explain, when a club head strikes a ball, the maximum compression force acts on the striking surface 2 whereas the maximum extension force acts of the rear surface of the club head. That is, extension occurs across the rear of the club head and compression occurs across the striking surface 2 of the club head, while a neutral axis, somewhere between the striking surface 2 and the rear of the club head, undergoes substantially no change insofar as compression or extension is concerned. Thus, the greater the distance between the back plate 21 and the neutral axis, the larger the tension acting across the rear of the club head. A woven cloth is capable of withstanding such a large tension especially when the longitudinal fibers in the woven cloth coincides with the direction of the maximum extension force acting across the rear surface of the club head.

Another aspect of the present invention which is enhanced by the embodiment shown in FIG. 10 is that of a damping mechanism. In this embodiment, not only does the epoxy resin backup 6, which can be quite elastic in nature, absorb a considerable degree of the shock and vibration caused by striking a ball, but the arrangement between the back insert 20 and the back plate 21 also facilitates the damping of such shock and vibration gradients. This stems from the use of the back insert bonding tape 22 and the double bonding tape 23. Upon striking a ball, a considerable degree of the shock and vibration is absorbed by the resin 6 because of the specific properties thereof. However, some shock and vibration gradients may remain. This portion of the shock and vibration caused by striking a ball causes small mutual displacement between the main body at the striking surface 2, the back insert 20 and the back plate 21. This necessarily leads to friction between these elements and the bonding tapes 22 and 23. More specifically, friction will occur between the back insert bonding tape and the bottom of the recess, between the back insert bonding tape 22 and the back insert 20, between the double bonding tape 23 and the back insert 20, and between the double bonding tape 23 and the back plate 21. This friction has the advantageous effect of damping a portion of the shock and vibration imparted to a players hand when striking a ball.

I should also be noted that the resiliency of the epoxy resin 6 ensures that no cracks are developed at the interfaces between the main body at the striking surface, the back insert 20, the back plate 21, the back insert bonding tape 22 and the double bonding tape 23.

Thus, while the foregoing description and figures illustrate some preferred embodiments of the improved iron club head in accordance with the present invention, it should be appreciated that certain modifications, including the interchangeability of the various features from the various embodiments, could be made and are encouraged to be made in the materials and techniques of the disclosed embodiment without departing from the spirit and scope of the present invention which is intended to be captured by the claims set forth immediately below.

What is claimed is:

1. An iron-type golf club head comprising, a main body member having a front side and a rear side, said main body member being made of a metal, said rear side including a recess, said front side including a wall section having an inner surface in communication with said recess and a shooting surface remote from said inner surface, a fiber reinforcement member disposed in said recess adjacent said inner surface of said wall section, a back plate disposed in said recess adjacent and generally coextensive in area with said fiber reinforcement member and remote from said inner surface of said wall section, and support means for fixing said fiber reinforcement member and said back plate in said recess, said fiber reinforcement member and said back plate establishing a reinforcement for said shooting surface when said golf club head strikes a ball.

2. The golf club head in claim 1, wherein said support means is made of a vibration damping material to minimize the shock and vibration felt by a player when said golf club head strikes a ball.

3. The golf club head in claim 1, wherein said support means is made of a resilient synthetic resin for minimizing the shock and vibration effect caused by striking a ball with said golf club head.

4. The golf club head in claim 1, wherein the thickness of said fiber reinforcement member from said front side to said rear side of said golf club head is relatively thin for shorter shafted golf clubs having a greater degree of loft, and becomes progressively thicker for longer shafted clubs having relatively small degrees of loft.

5. The golf club head in claim 1, wherein said back plate is a woven cloth.

6. The golf club head in claim 5, wherein said woven cloth is made of carbon fibers.

7. The golf club head in claim 6, wherein said main body member includes a toe portion and a heel portion, and the longitudinal direction of said carbon fibers of said woven cloth are substantially aligned from said, toe portion to said heel portion.

8. The golf club head in claim 5, wherein said woven cloth is made of aramide fibers.

9. The golf club head in claim 8, wherein said main body member includes a toe portion and a heel portion, and the longitudinal direction of said aramide fibers of said woven cloth are substantially aligned from said toe portion to said heel portion.

10. The golf club head in claim 1, wherein said rear side includes an upwardly extending rear upright remote from said wall section such that said reinforcement member, said back plate and said support means are disposed between said rear wall member and said wall section, said rear upright having a predetermined size so as to adjust the center of gravity of said golf club head.

11. The golf club head in claim 1 further comprising a first bonding tape between said fiber reinforcement member and said inner surface of said wall section.

12. The golf club head in claim 11, further comprising a second bonding tape between said fiber reinforcement member and said back plate.

* * * * *